United States Patent [19]

Hudelmaier

[11] Patent Number: 4,544,275

[45] Date of Patent: Oct. 1, 1985

[54] CONCRETE MIXER TRUCK

[75] Inventor: Gerhard Hudelmaier, Ulm, Fed. Rep. of Germany

[73] Assignee: Ingrid Hudelmaier, Fed. Rep. of Germany

[21] Appl. No.: 592,141

[22] Filed: Mar. 22, 1984

[30] Foreign Application Priority Data

Mar. 23, 1983 [DE] Fed. Rep. of Germany ..... 3310570

[51] Int. Cl.[4] ..... B28C 7/12

[52] U.S. Cl. ..... 366/30; 366/40; 366/151

[58] Field of Search ..... 366/17, 34, 36, 40, 366/54, 60, 61, 151, 152, 167, 176, 30

[56] References Cited

U.S. PATENT DOCUMENTS

| | | | |
|---|---|---|---|
| 2,954,215 | 9/1960 | Warmkessel | 366/17 |
| 3,593,966 | 7/1971 | Munroe | 366/40 |
| 3,826,476 | 7/1974 | Ahrenberg | 366/17 |
| 3,912,239 | 10/1975 | Ries | 366/40 |
| 4,436,429 | 3/1984 | Strong | 366/40 |

FOREIGN PATENT DOCUMENTS 385447 12/1932 United Kingdom .

*Primary Examiner*—Robert W. Jenkins

*Attorney, Agent, or Firm*—Arnold, White & Durkee

[57] ABSTRACT

The invention relates to a concrete mixer truck having a mixer drum adapted to be rotatably driven, a water container, a water conduit leading from the container to the drum, and a water pump. An object of the invention is to prevent the quality of a properly composed mixture contained in the drum from being deteriorated by unintentional addition thereto of water from the water container. This is accomplished by the use of a measuring device determining the drive torque for the mixer drum and a valve disposed in the water conduit and controlled by said measuring device in such a manner that the water conduit is closed when the drive torque exceeds a selectively adjustable rated value corresponding at least to the drive torque required for the empty drum.

For special conditions of for instance climatic nature requiring the addition of a limited amount of water prior to use, a further development of the invention provides the employ of a water supply opening switch adapted to be opened once during each valve-closure phase for admitting a limited and preselected amount of water.

11 Claims, 4 Drawing Figures

CONCRETE MIXER TRUCK

DESCRIPTION

Figure 1:
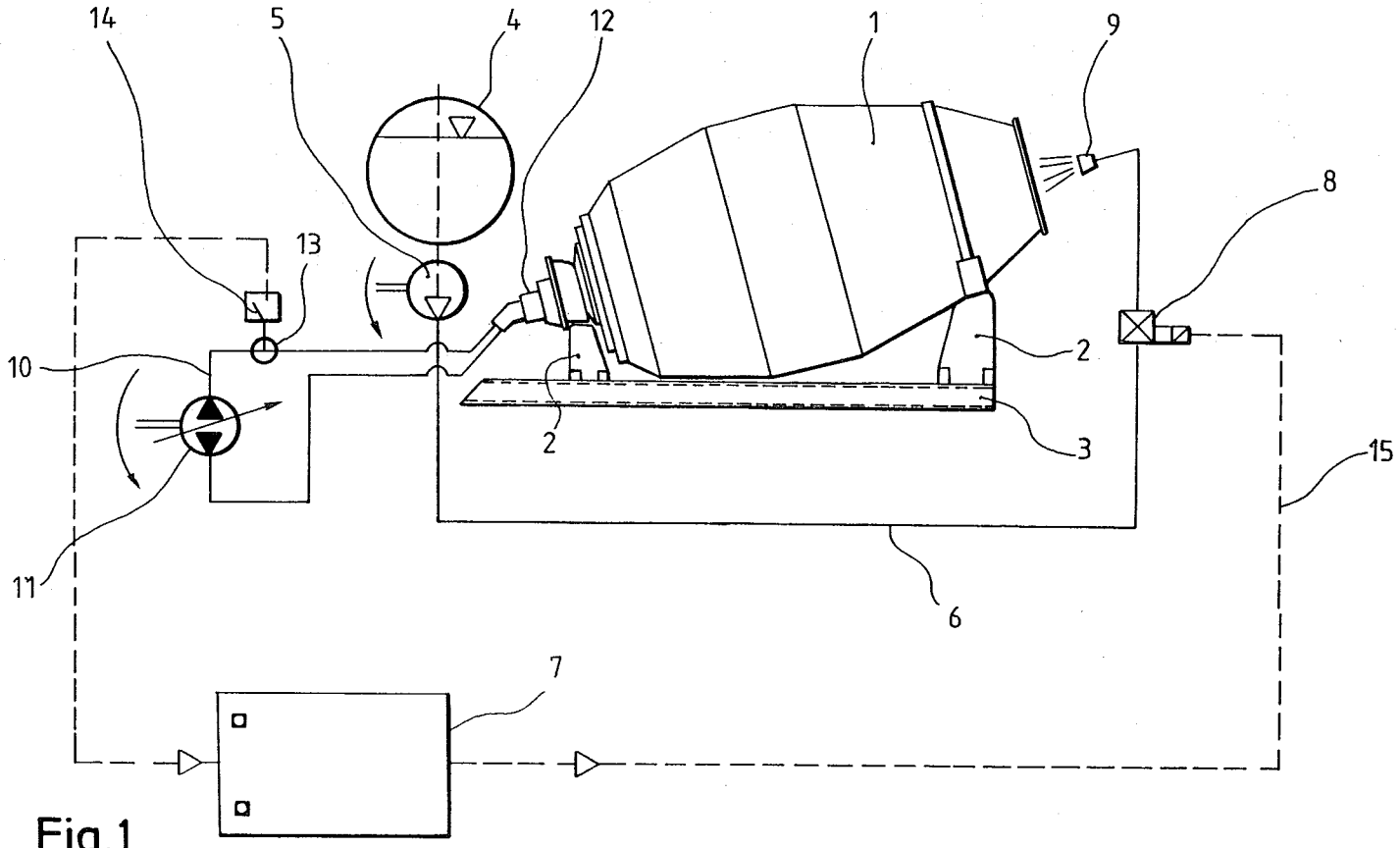

The present invention relates to a concrete mixer truck of the type defined in the generic clause of claim 1.

Concrete mixer trucks are filled with a concrete mixture at a central supply source for transporting it to a construction site. At the central supply source, the quality of the concrete is meticulously adjusted by controlled metering of all components. This applies in particular to the aamount of the water added in proportion to the cement, as an excessive water content may considerably reduce the compression strength of the solidified concrete. Mixer trucks of the type under discussion are generally provided with a water tank having a water outlet conduit opening into the mixer drum for cleaning the latter after the concrete mixture has been discharged therefrom. This leads to the danger that additional amounts of water are admitted to the mixer drum during travel or at the construction site, resulting in alterations of the quality of the concrete lying beyond the control of the concrete supplier.

It is an object of the present invention to improve a concrete mixer truck of the type set forth in the introduction so as to exclude the uncontrolled addition of water from the water tank to a concrete mixture contained in the mixer drum.

This object is attained according to the invention by the provisions of the characterizing clause of claim 1.

The drive torque values for an empty mixer drum as well as those for a partially or completely fileld drum are easily determined. This permits the rated value to be readily selected and adjusted in such a manner that the exceeding thereof reliably indicates the presence of an amount of a concrete mixture in the mixer drum. An additional supply of water is then undesirable. The rated value does not have to correspond exactly to the completely empty condition of the drum, as possible alterations of the rotation resistance or the presence of residues within the drum might otherwise prevent cleaning of the drum. Moreover, there is little danger of any uncontrolled addition of water after the major part of the concrete mixture has already been discharged.

A preferred embodiment of the measuring device is defined by the characterizing feature of claim 2. The pressure within the hydraulic system is dependent on the torque demanded of the drive motor. Pressure sensing devices are of simple construction and readily adjustable for the required control function, while being additionally suitable for heavy-duty service.

A structurally and functionally simple embodiment of the valve is set forth in claim 3.

An advantageous further development of the concrete mixer truck according to the invention is characterized by the feature set forth in claim 4. In place of a complete cut-off of the water supply, this feature provides for a controlled supply of additional water to the concrete mixture limited to a maximum amount at a single operation. This possibility is provided in consideration of the fact that various influences may result in an alteration of the concrete's consistency during transport from the supply source to the construction site. Such influences may for instance be dependent on the length of the transport distance, on weather conditions or on the properties of individual mixture components. The additional amount of water required under these conditions is redily determinable. The limitation of the additional amount of water to be added in a single operation is thus determined by two criteria, namely, the absolute maximum amount possible required due to consistency alteration, and the maximum amount that may be added without inadmissibly altering the strength values of the concrete.

Advantageous embodiments of this aspect of the invention are set forth in claims 5 to 8.

In the case of a concrete mixer truck having an ON and OFF switching device for the water supply, the respective device may be designed in a simple manner in accordance with the characteristic of claim 9, enabling it to carry out the specific functions according to the invention.

Figure 2:
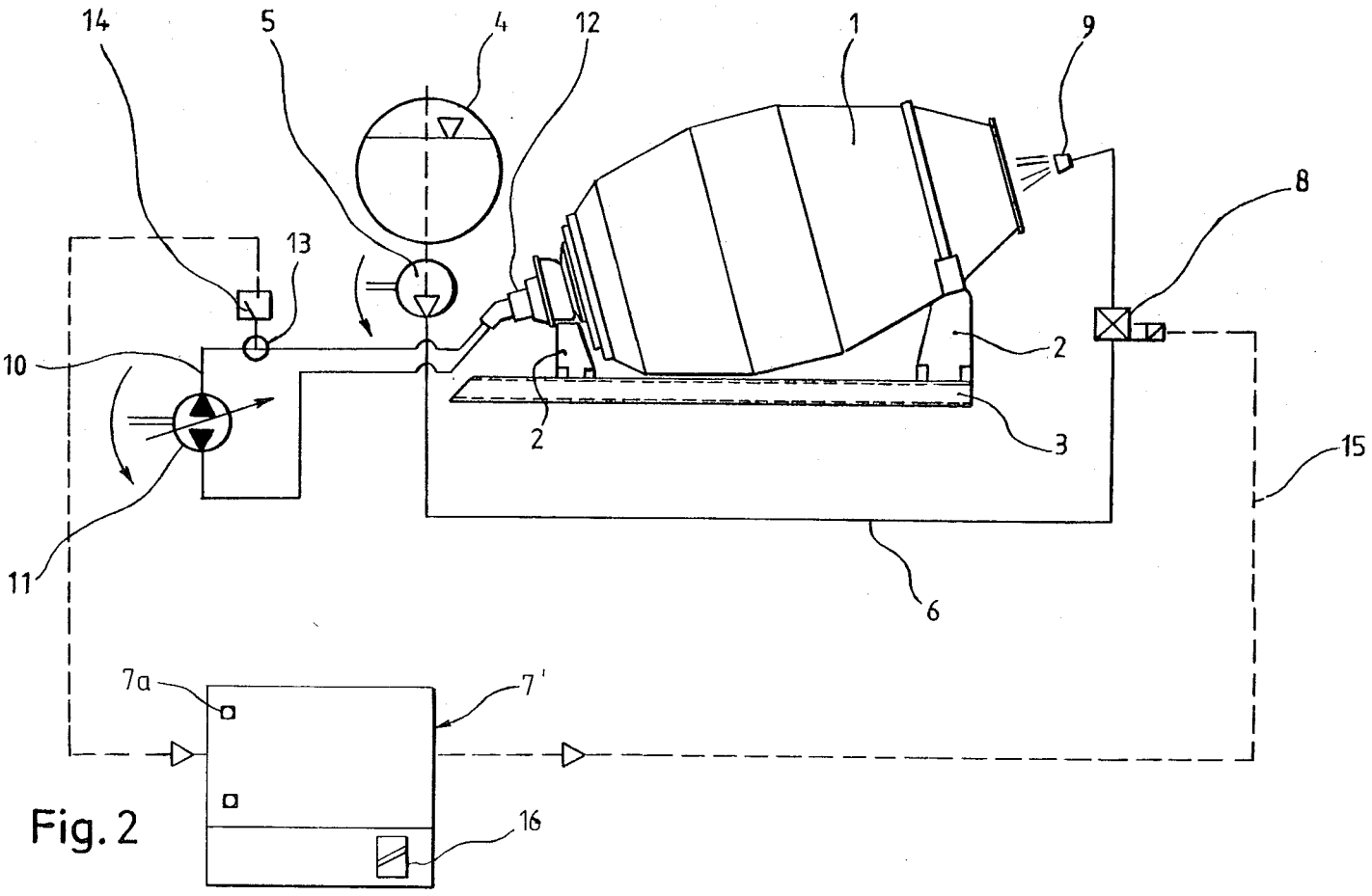
Figure 3:
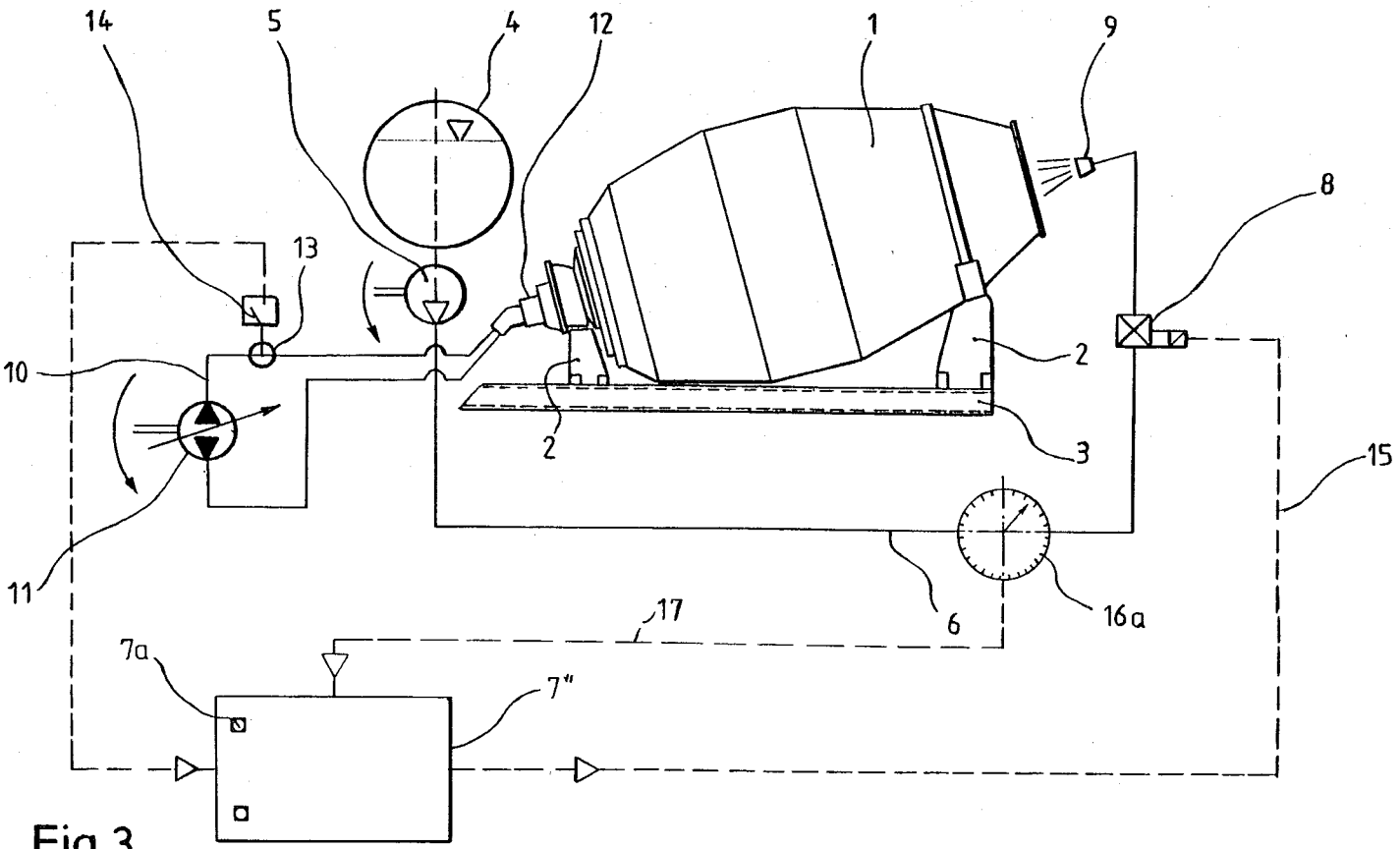
Figure 4:
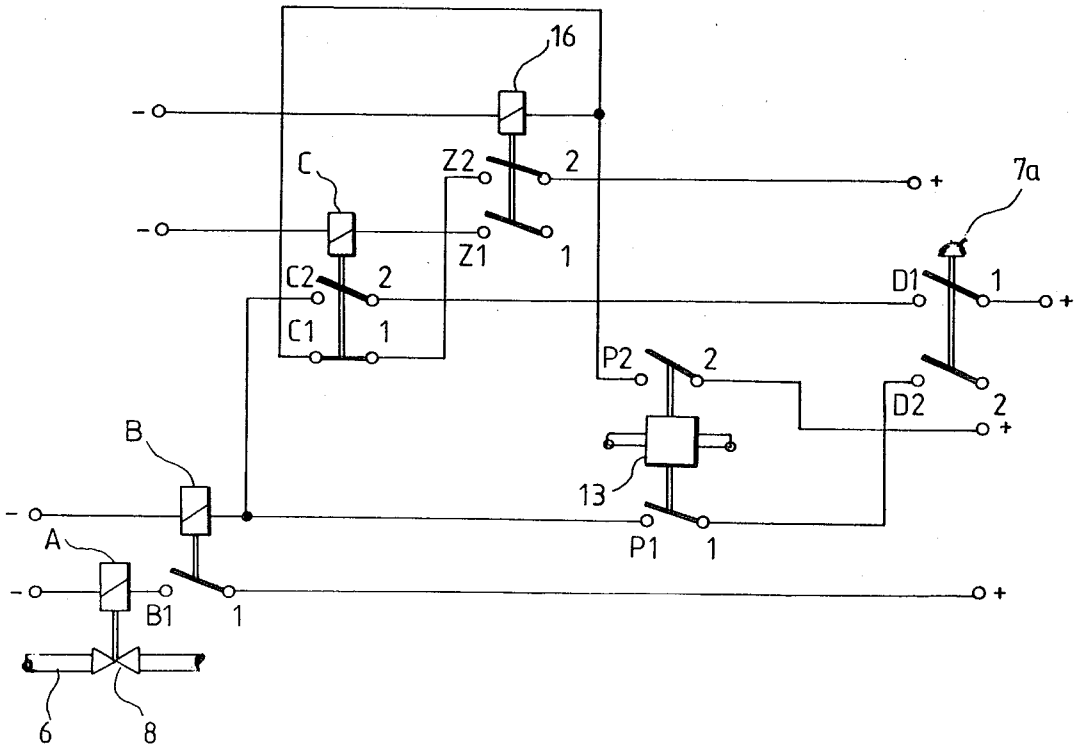

Embodiments of concrete mixer trucks according to the invention shall now be described with reference to the accompanying drawings, wherein:

FIG. 1 shows a diagrammatic representation of a concrete mixer truck including drive and control systems, FIG. 2 shows a diagrammatic representation corresponding to FIG. 1 of a different embodiment, FIG. 3 shows a further embodiment, and FIG. 4 shows a circuit diagram.

In the drawings, a concrete mixer truck is diagrammatically indicated by a mixer drum 1 mounted by means of supports 2 on a frame 3 of a vehicle not shown in further detail. Also mounted on the vehicle is a water container 4 and a water pump 5 connected thereto. A water conduit generally indicated at 6 leads from pump 5 via a water supply ON and OFF switching device 7 and a valve 8 to a location adjacent the drum opening. At this location conduit 6 is connected to a spray nozzle 9 directed towards the interior of drum 1.

Mixer drum 1 is adapted to be rotatably driven by means of a hydraulic system generally designated 10. It includes a hydraulic pump 11 and a hydraulic motor 12 operatively connected to drum 1. Also provided is a pressure sensing device 13 adapted to actuate a switch as a preselected rated pressure is exceeded. An electric lead 15 connects the switch 14 to valve 8 designed as a solenoid valve.

The described circuits formed by water conduit 6, hydraulic system 10 and electric lead 15 cooperate with one another in th following manner during transport of a concrete mixture: At a central supply location, drum 1 is filled with a concrete mixture of a carefulle determined composition. During travel to the construction site and discharge of the concrete mixture thereat, drum 1 is rotated at least intermittently. After the concrete mixture has been discharged, ON and OFF switching device 7 is actuated, so that water from container 4 is injected into drum 1 through nozzle 9. During this cleaning step the drum is also rotated. The water pump is driven together with the drum, the water flows only, however, after ON and OFF switching device 7 has been actuated.

The torque required for driving the mixer drum is dependent on the filling degree thereof. The smallest drive torque is thus obviously required for the empty drum. The magnitude of the drive torque on its part determines the pressure acting in the hydraulic system 10 and sensed by the pressure sensing device 13. For preventing water from being added at an uncontroleld amount to the properly composed concrete mixture, solenoid valve 8 is kept closed through pressure sensing device 13 or switch 14 actuated thereby, respectively, as long as the drum is filled with the concrete mixture. To this effect, pressure sensing device 13 is adjusted to a rated value corresponding to the pressurde required for rotating the empty drum plus a small allowance for operational variations. This allowance is intended to prevent the water shut-off from remaining or coming into effect if small amounts of concrete mixture remain in the drum of the rotation resistance of the drum increases due to outer influences, bearing damage or the like. As the pressure within the hydraulic system increases over the selected rated value, pressure sensing device 13 operates to actuate switch 14 for closing solenoid valve 8. Even if ON and OFF switching device 7 is now actuated, water from container 4 cannot be sprayed into drum 1 before the concrete mixture has been discharged therefrom.

FIGS. 2 and 3 show substantially similar embodiments of the concrete mixer truck of FIG. 1. The structural components are substantially the same and therefore designated by the same reference numerals.

In the concrete mixer trucks according to FIGS. 2 and 3, switch 14 does not directly actuate valve 8, but indirectly actuates the ON and OFF switching device. The latter contains an opening switch 7*a* adapted to be operated once during the water shut-off phase for admitting a limited amount of water.

FIG. 4 shows a circuit diagram for this water shut-off phase with the possibility of a single-operation limited water supply, with all switches shown in the deenergized state.

As the pressure decreases below the selected rated value, contacts P1-1 and P2-2 of pressure sensing device 13 close. A control element 16, in this case a timing relay, is energized so that its contacts Z1-1 and Z2-2 close. If opening switch 7*a* is now actuated so as to close its contacts D1-1 and D2-2, relay B is energized so that its contact B1-1 closes. This causes a relay A to be energized for opening valve 8. At the saem time a relay C is energized through contacts Z2-2 This results in further energization of relay B, although with no result on the overall operation. Timing relay 16 remains energized as long as contact P2-2 remains closed.

As the pressure increases to exceed the rated value, pressure sensing device 13 responds to open contacts P1-1 and P2-2, whereby relays B and C are denergized. Relay A is likewise deenergized, causing valve 8 to close. Timing relay 16 remains energized through the self-holding circuit formed by contacts Z2-2 and C1-1. Actuation of opening switch 7*a* causes relays C and B to be energized to close contacts C2-2 and B1-1, respectively. Relay A is energized and causes valve 8 to open. Energization of relay C further causes contact C1-1 to open, so that timing relay 16 is deenergized after a predetermined delay. This results in relays A and B being deenergized, causing valve 8 to close. Repeated actuation of opening switch 7*a* remains without effect as long as pressure sensing device 13 is in its pressure-responding state with its contacts P1-1 and P2-2 open. Repetition of the valve-opening operation requires timing relay 16 to be again energized through the contacts of pressure sensing device 13, to be accomplished only after the pressure has again decreased.

The delay controlled by the timing relay 16 may be selected depending on the filling degree of the drum and/or the composition of the concrete mixture contained therein. In addition it is adjusted in response to the pump output per time unit, so as to ensure that the consistency and/or the strength properties of the concrete contained in the drum will not deteriorate below admissible values even if the single-operation supply of additional water occurs unintentionally or unnecessarily.

The concrete mixer truck of FIG. 3 is provided with a control element in the form of a flow counter 16*a* installed in water conduit 6 and connected to ON and OFF switching device 7″ via a control lead 17. Flow counter 16*a* is started on actuation of opening switch 7*a* and is effective to positively interrupt the supply of water when the preselected amount has been supplied to the drum. The selection of this amount is determined by the above discussed criteria. The circuit arrangement may substantially correspond to the one shown in FIG. 4.

The invention is not restricted to the exemplary embodiments shown and described. Within the scope of the invention it is thus possible to measure the drive torque for the drum in a different manner, for instance at the mounting arrangement of the drum, for interrupting the water supply in response thereto. The switching aggangements and the circuitry associated therewith may be varied within the scope of known arrangements for the present purpose. In particular, switch 14 may be connected to prevent operation of ON and OFF switching device 7, 7′ or 7″, respectively, in the water supply shut-off state instead of directly acting on valve 8. It is also possible to shut off operation of the water pump, although this solution is somewhat more complicated.

I claim:

1. A concrete mixer truck comprising: a mixer drum adapted to be rotatably driven by means of a hydraulic system; a water container; a water conduit leading from said container to said drum; a water pump; a measuring device for sensing the drive torque of said mixer drum, said measuring device comprising a pressure sensor for sensing the pressure prevailing in the hydraulic system for determining the drive torque; and a valve included in said water conduit an adapted to be controlled in response to said measuring defice so as to close said water conduit when said drive torque lies above a selectively adjustable rated value at least above the drive torque for the empty mixer drum.

2. A mixer truck according to claim 1, said measuring device being connected to an electic switch controlling an electric circuit, said valve being in the form of a solenoid valve.

3. A mixer truck according to claim 1, said valve being operatively connected to an opening switch adapted to be operated once during each valve closure phase for the supply of a positively limited amount of water.

4. A mixer truck according to claim 3, said opening switch being operatively connected to a water supply control element adapted to be activated by a switching operation in the valve closure phase and adapted to positively close said valve if the water supply is not stopped prior to attaining a preselected amount of water.

5. A mixer truck according to claim 4, said control element comprising a timing means.

6. A mixer truck according to claim 4, said control element comprising a flow counter.

7. A concrete mixer truck according to any of claims 1 to 6, including a water supply ON and OFF switching device, said ON and OFF switching device being disposed between said measuring device and said valve and including said opening switch.

8. A mixer truck according to claim 7, said ON and OFF switching device being operatively connected to said control element.

9. A concrete mixer truck comprising:

a mixer drum adapted for receiving a concrete and water mixture a hydraulic drive system operable for rotating the mixer drum, said hydraulic system being operable at or below a certain hydraulic pressure to apply a certain drive torque for rotating a substantially empty mixer drum and operable at a hydraulic pressure greater than said certain pressure to apply a drive torque for rotating a mixer drum containing a concrete and water mixture;

a water container;

a water conduit leading from said container to said drum;

a valve operable for stopping flow of water through the conduit; and a measuring device having a sensor operatively coupled to said hydraulic system, said device being operably coupled to said valve for normally preventing water flow through the conduit when said hydraulic system is operating to apply a drive torque greater than said certain drive torque.

10. A concrete mixer truck in accordance with claim 9, said sensor being a pressure sensor adapted for sensing hydraulic pressures correspondingly associated with respective drive torques.

11. A concrete mixer truck in accordance with claim 9, including;

an opening switch operatively connected to said valve, said opening switch operable to permit said valve to open for a limited time when said drive torque is greater than said certain torque, said opening switch being constructed to permit a limited amount of water to be added to the drum when said drive torque is greater than said certain torque.

* * * * *

UNITED STATES PATENT AND TRADEMARK OFFICE

CERTIFICATE OF CORRECTION

PATENT NO. : 4,544,275

DATED : October 1, 1985

INVENTOR(S) : Gerhard Hudelmaier

It is certified that error appears in the above-identified patent and that said Letters Patent is hereby corrected as shown below:

In Column 4, line 41, please delete "an" and insert therefor --and--.

In Column 4, line 42, please delete "defice" and insert therefor --device--.

In Column 4, line 44, after the word "value", please insert a comma.

In Column 5, line 8, after the word "mixture", please insert a semicolon.

Signed and Sealed this

*Third* Day of *December 1985*

[SEAL]

*Attest:*

DONALD J. QUIGG

*Attesting Officer* *Commissioner of Patents and Trademarks*